US006712351B2

(12) United States Patent
Hsieh

(10) Patent No.: US 6,712,351 B2
(45) Date of Patent: Mar. 30, 2004

(54) SHEET FEEDING APPARATUS

(75) Inventor: Yen-Sung Hsieh, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/135,400

(22) Filed: May 1, 2002

(65) Prior Publication Data

US 2002/0163117 A1 Nov. 7, 2002

(30) Foreign Application Priority Data

May 3, 2001 (TW) ..... 90110666 A

(51) Int. Cl.[7] ..... B65H 3/34; B65H 3/52
(52) U.S. Cl. ..... 271/121; 271/137; 271/167
(58) Field of Search ..... 271/121, 137, 271/167, 124; B65H 3/34, 3/52

(56) References Cited

U.S. PATENT DOCUMENTS

| | | | | |
|---|---|---|---|---|
| 4,511,135 A | | 4/1985 | Huerta et al. | |
| 5,052,677 A | * | 10/1991 | Shibata | 271/164 |
| 5,527,029 A | | 6/1996 | Bortolotti et al. | |
| 5,857,671 A | | 1/1999 | Kato et al. | |
| 5,899,450 A | * | 5/1999 | Gettelfinger et al. | 271/121 |
| 5,918,873 A | * | 7/1999 | Saito et al. | 271/10.11 |
| 6,064,852 A | | 5/2000 | Maekawa | |
| 6,065,886 A | * | 5/2000 | Embry et al. | 400/629 |
| 6,095,515 A | | 8/2000 | Kiyohara et al. | |
| 6,139,007 A | * | 10/2000 | Cahill et al. | 271/121 |

FOREIGN PATENT DOCUMENTS

| | | | | |
|---|---|---|---|---|
| EP | 0 386 737 A2 | | 9/1990 | |
| EP | 0 672 601 A1 | | 9/1995 | |
| JP | 4-251048 | * | 9/1992 | B65H/3/52 |
| JP | 4-354740 | * | 12/1992 | B65H/3/52 |
| JP | 7-2382 | * | 1/1995 | B65H/3/56 |

* cited by examiner

*Primary Examiner*—Donald P. Walsh
*Assistant Examiner*—Kenneth W Bower
(74) *Attorney, Agent, or Firm*—Rabin & Berdo, P.C.

(57) ABSTRACT

A sheet feeding apparatus, comprising a pad base, a groove along the central line of the pad base, and a spring embedded in the groove, is disclosed. The top of the spring protrudes above the top surface of base and a series of inclined protrusions are formed at two sides of the groove. The sheets are driven by rollers and rise gradually along the protrusions such that the sheets are separated one-by-one. Moreover, a radial arrangement of the ribs and the sheet-separating pad allows the lower edge of each sheet to move smoothly so that paper jams can be prevented.

7 Claims, 12 Drawing Sheets

SHEET FEEDING APPARATUS

This application incorporates by reference Taiwan application Serial No. 090110666, filed May 3, 2001.

BACKGROUND OF THE INVENTION

1. Field of the Invention

The invention relates in general to a sheet feeding apparatus, and in particular, to a sheet feeding apparatus using an elastic device.

2. Description of the Related Art

The performance of the conventional image forming apparatus, such as a printer, copy machine, facsimile machine, or the like, is greatly affected by the quality of sheet feeding. A sheet feeding apparatus capable of separating and feeding sheets one-by-one smoothly and continuously is therefore in great demand.

Taking the printer as an example of the image forming apparatus, a conventional sheet feeding apparatus is illustrated in FIG. 1A. The printer is typically equipped with an automatic sheet feeding apparatus, wherein sheets of papers are first positioned at a rest plate and driven one-by-one by the sheet feeding apparatus to the image forming apparatus. In FIG. 1A, a base 101 for supporting the sheets is at the bottom of the automatic sheet feeding apparatus. A roller 150 is installed above the base 101 to drive the sheets forward. The base 101 has a sheet-separating pad 103, for separating sheets one-by-one, and a number of smooth ribs 102.

The front view shown in FIG. 1B illustrates the movement of the sheets. The sheet separating pad 103 and the smooth ribs 102 are located on the base 101 of the automatic sheet feeding apparatus and are parallel to each other. The ribs 102 act to elevate the sheets in order to facilitate the smooth movement of the individual sheets. Materials with low friction coefficient are ideal for the manufacture of the ribs 102; thus a smooth rubber or plastic is frequently used because of the additional advantage of low cost. The side view shown in FIG. 1C illustrates the movement of the sheets. The sheet 105 is driven by the roller 150 (not shown), and is moved along the direction A. The front edge 107 of the sheet 105 touches the surfaces of the ribs 102 and slides along the direction A.

Then referring to FIG. 1D, the friction force to the sheet is illustrated. While the sheet 105 is forwarded along the direction A, the ribs 102 generate a friction force against the movement of the sheet 105. If the thickness of the sheet 105 reaches to a certain level, the friction force will not have much influence on the movement of the sheet. However, if the sheet 105 is thin, the lower edge 107 can bend around, instead of moving forward smoothly, as shown in FIG. 1E.

In FIG. 1E, the lower edge 107 of sheet 105 is in contact with the ribs 102. The roller (not shown) drives the sheet 105 forward along the direction A, but the friction force pushes the sheet backward along the direction B. As the roller continues to drive the sheet 105, the sheet 105 can potentially roll up and cause a paper jam.

In addition to the ribs 102, the sheet-separating pad 103 is also a key element of the conventional base 101. FIG. 2 shows the side view of the sheet-separating pad 103 and the sheets 105. The sheet-separating pad 103 is shaped similarly to a saw in that it has a number of sawtooth-like protrusions 106. Each protrusion 106 rises up at an angle $\alpha$. The friction force generated by the sheet-separating pad 103 against the sheets is large enough to separate each sheet. The sheet-separating pad 103 is typically positioned along the sheet moving direction A. Thus, as the sheet 105 moves and rises along the sawtooth-like protrusions 106, it is separated from the other sheets. The movement of the sheet 105 depends on the angle $\alpha$ and the friction coefficient, which is affected by the material and thickness of the sheet 105.

The type of printing sheet can vary greatly, with the material and thickness being just two factors. The thickness, usually defined by $g/m^2$, can vary within a wide range, for example, from thick postcards, envelopes, and plastic plates to thin plain papers. The conventional sheet-separating pad is designed to satisfy a certain range of printing materials. The incline angle $\alpha$ and the material type (which affects the coefficient of friction) of the sheet separating pad 103 are determined factors, thus only printing materials within the designated range are suitable. Printing materials outside the designated range may cause paper jams or reduce the sheet feeding accuracy. Furthermore, the high precision requirement in the manufacturing of the sheet-separating pad causes difficulties in fabrication and results in higher cost. To summarize, the disadvantages of the conventional sheet feeding apparatus comprise the following:

1. paper jams;
2. limited printing materials;
3. less accuracy in sheet separation; and
4. higher cost in fabrication of the sheet-separating pad.

SUMMARY OF THE INVENTION

It is therefore an object of the invention to provide a sheet feeding apparatus that enhances the stability of sheet separation and reduces the potential for paper jams.

According to the object of the invention, a sheet-separating pad for use in a sheet feeding apparatus is disclosed. The sheet-separating pad comprises a pad base having a top surface and a groove. Numerous inclined protrusions are formed at one or two sides of the groove on the top surface of the base to guide the sheet(s) in a certain direction. An elastic device, such as a spiral spring or a series of connected spring leaves, is situated in the groove. The spiral spring or series of spring leaves protrudes above the top surface of the base in order to separate the sheets. Driven by rollers, the sheets rise gradually along the protrusions so that the sheets can be separated one-by-one. Moreover, the radial arrangement of the ribs and the sheet-separating pad allows the lower edge of each sheet to move forward smoothly such that a paper jam can be prevented.

Other objects, features, and advantages of the invention will become apparent from the following detailed description of the preferred but non-limiting embodiments. The following description of the preferred embodiments of the present invention is made with reference to the accompanying drawings.

DETAILED DESCRIPTION OF THE INVENTION

Figure 3A:
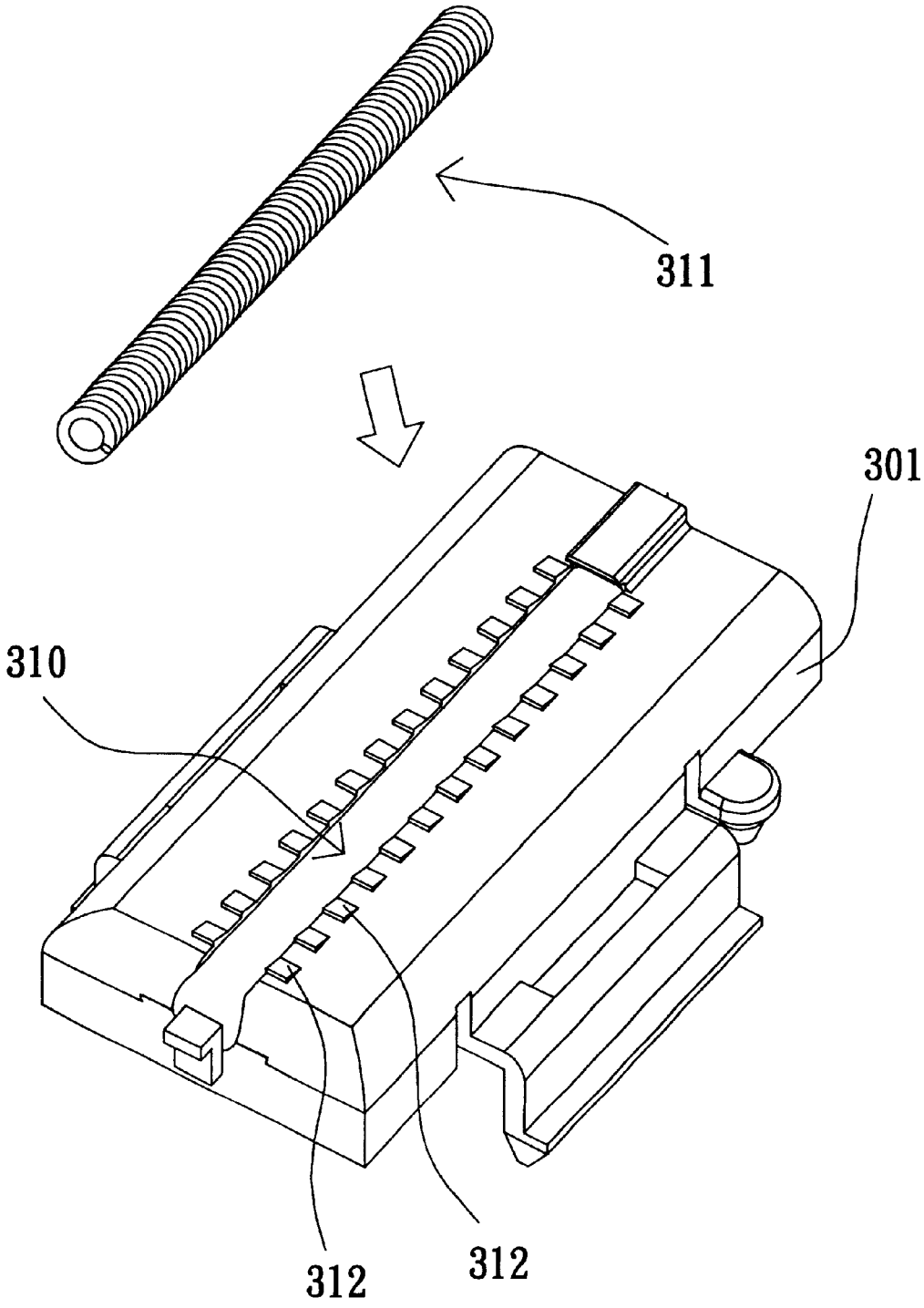
FIGS. 3A and 3B show the sheet-separating pads according to a preferred embodiment of the invention.
Figure 3B:
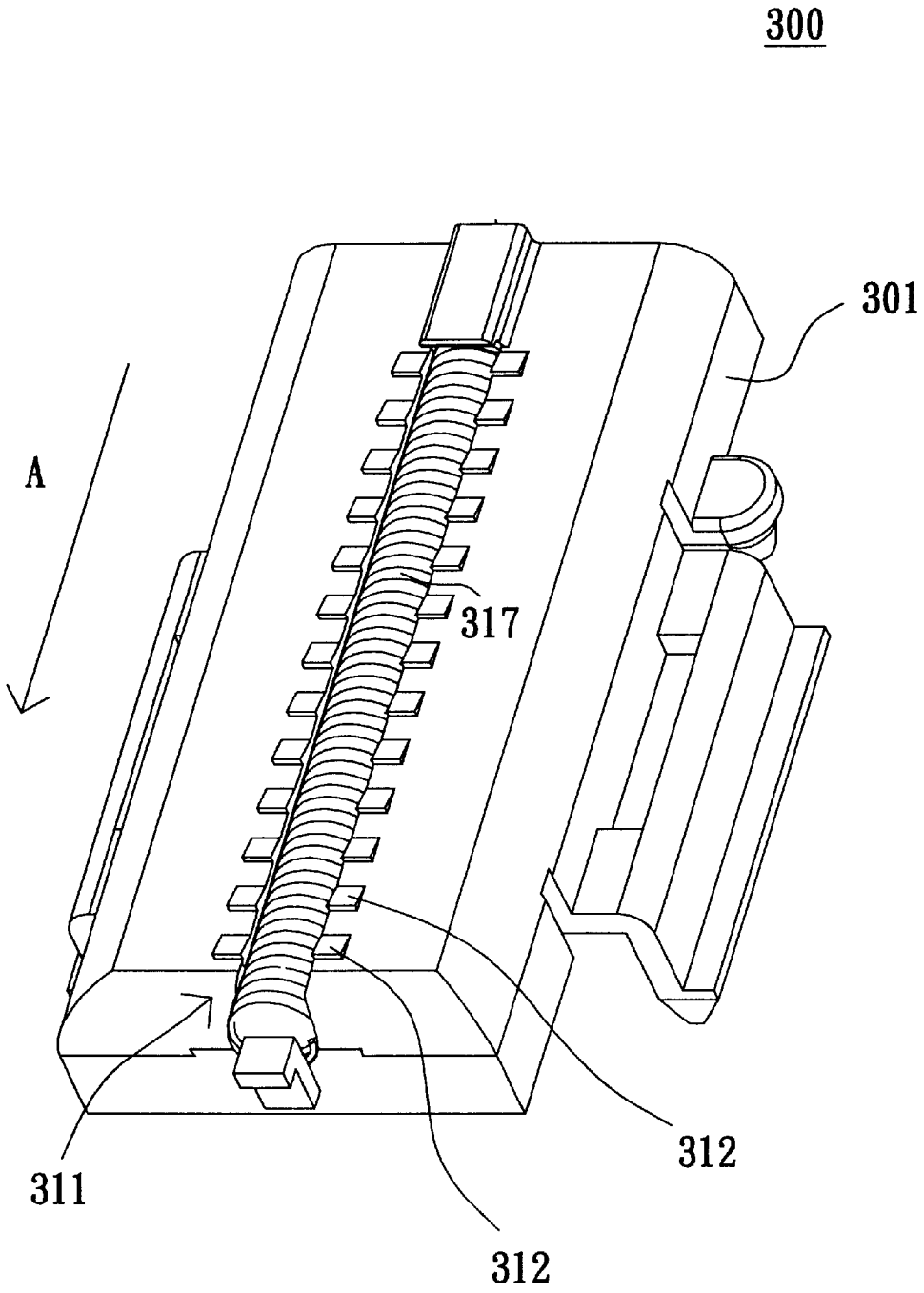
Figure 3C:
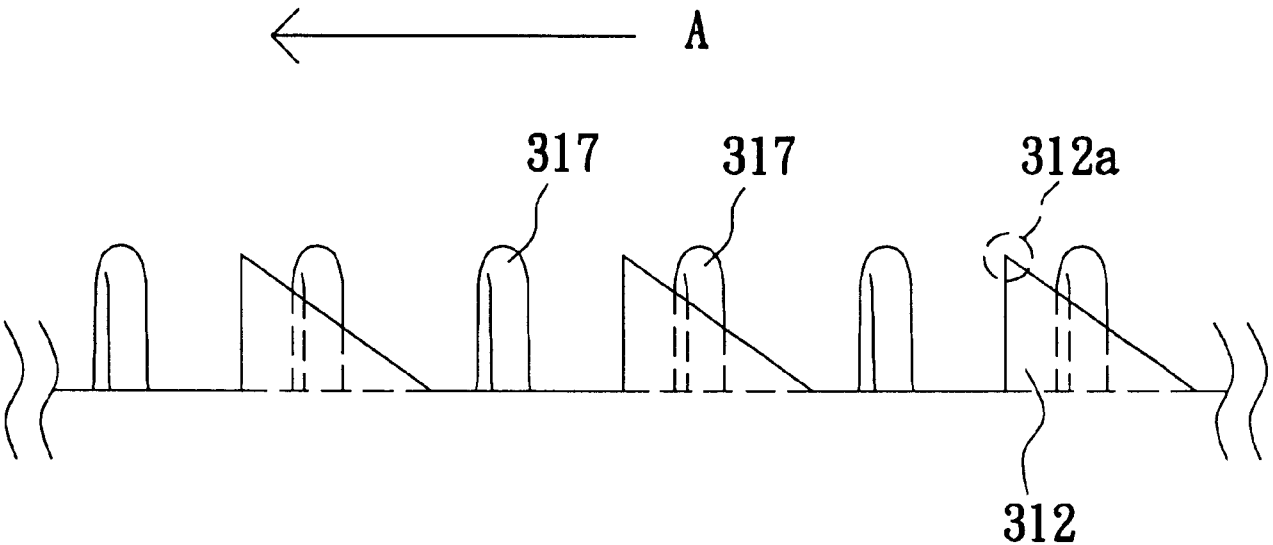
FIG. 3C shows the side view of the pad base and the spiral spring according to a preferred embodiment of the invention.

FIGS. 3A and 3B show the sheet separating pad according a preferred embodiment of the invention. The sheet separating pad 300 comprises the pad base 301, the groove 310, and the spiral spring 311. The spiral spring 311 is positioned within the groove 310. The groove 310 is formed along the central line of the pad base 301 and the longitudinal axis of the groove 310 is parallel to the direction of the sheet movement. The spiral spring 311 and the groove 310 are designed so that the top of the spiral spring 311 is higher than the top surface of the pad base 301. While the paper sheet (not shown) is positioned above the sheet-separating pad 300, the lower edge 107 of the sheet is in contact with a spring ring 317 of the spiral spring 311. As the sheet 105 is driven forward to the paper exit, the spring ring 317, which is in contact with the sheet 105, also is driven forward. Referring to FIG. 3C, numerous inclined protrusions 312 are formed at either one or both sides of the groove 310 for guiding the paper sheet 105. When the paper sheet 105 is driven forward, the lower edge 107 of the sheet 105 slides on the top surface of the inclined protrusion 312 and guided by the protrusion 312 to move upward gradually. When the lower edge 107 is driven onto the highest point 312*a* of the inclined protrusion 312, the lower edge 107 will easily move over the first spring ring which was firstly in contact with the sheet 105, and then the lower edge 107 will move to contact the next spring ring 317. After the lower edge 107 moves over the first spring ring, the first spring ring once pushed forward will return to its original position. By repeating the above-mentioned steps, these paper sheets can be separated accurately one-by-one.

In FIG. 3C, the side view of the base and the spiral spring 311 is shown. The top of each spring ring 317 is higher than the top surface of the base 301, and is approximately as high as the highest point 312*a* of the inclined protrusion 312. As a result, after the sheet 105 is driven to move over the first spring ring 317 and the protrusion 312, the sheet 105 will move from the first spring ring until it reaches the next ring. The protrusions 312 can be either (a) separated structures fixed onto the base 301 one-by-one, or (b) structures integrally formed with the base 301 through a single molding process.

Figure 4A:
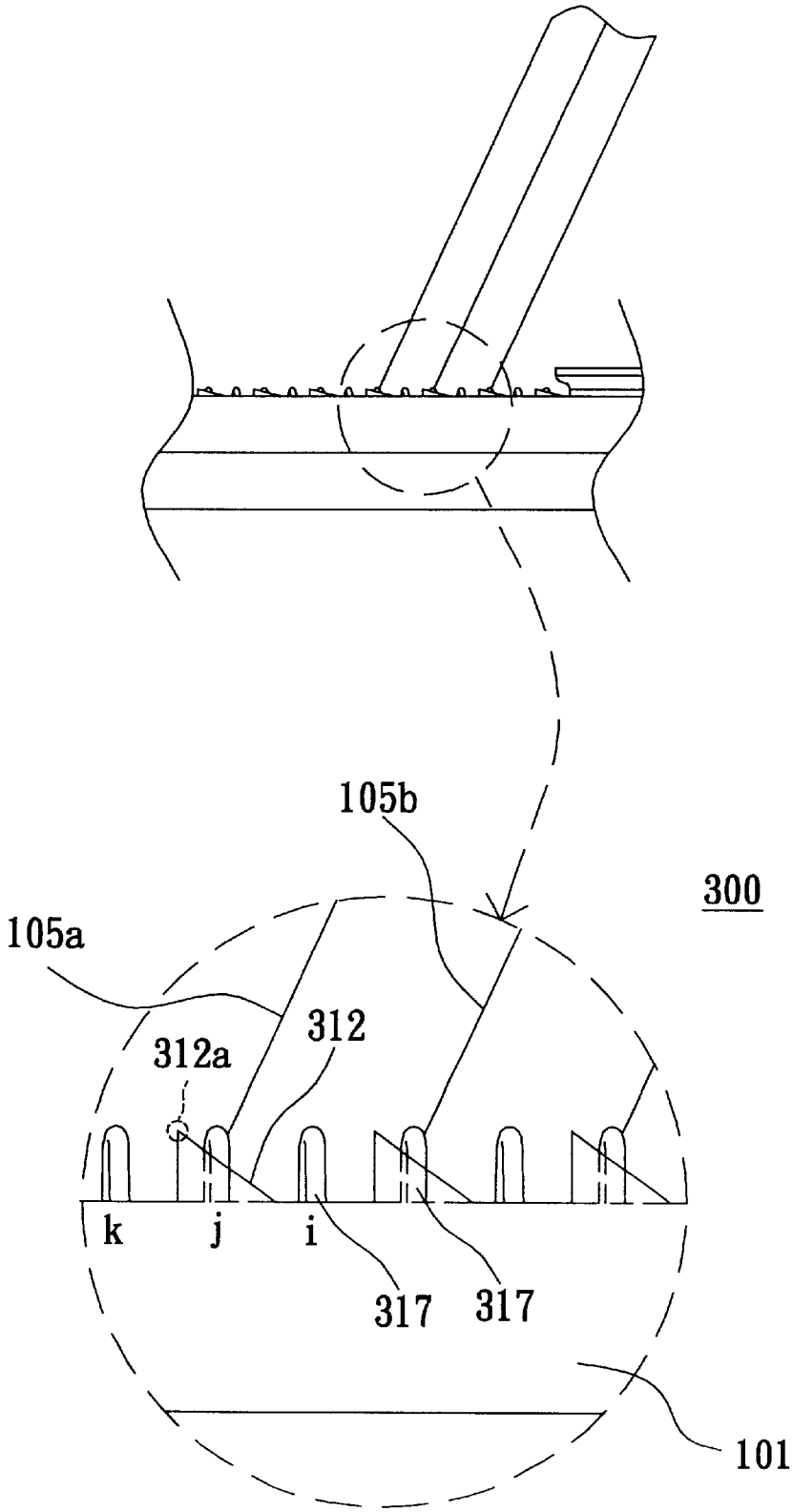
FIG. 4A shows a portion of the sheet-separation pad according to a preferred embodiment of the invention.
Figure 4B:
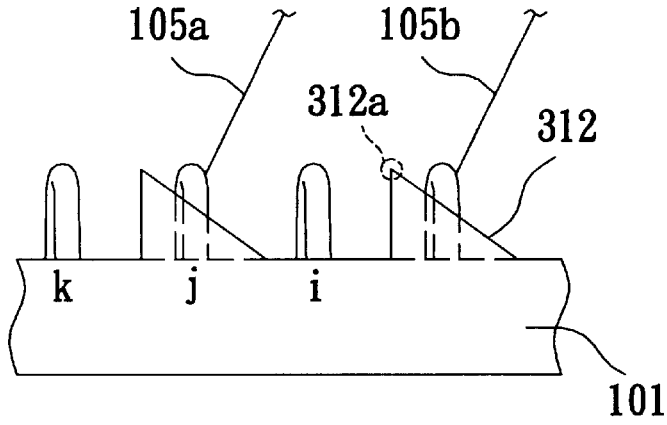
FIG. 4B to FIG. 4D show the process of sheet separation using a sheet feeding apparatus of the present invention.
Figure 4C:
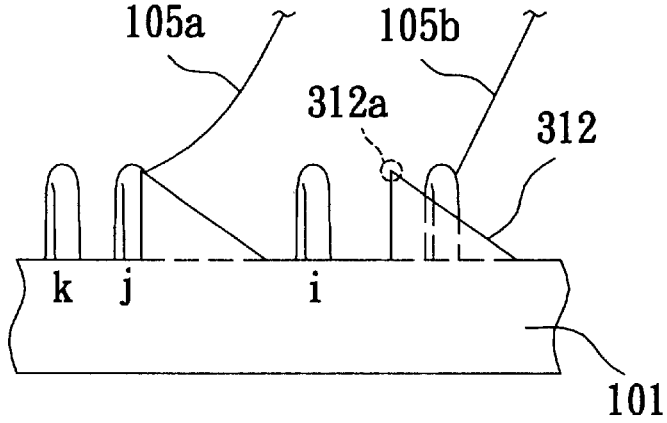
Figure 4D:
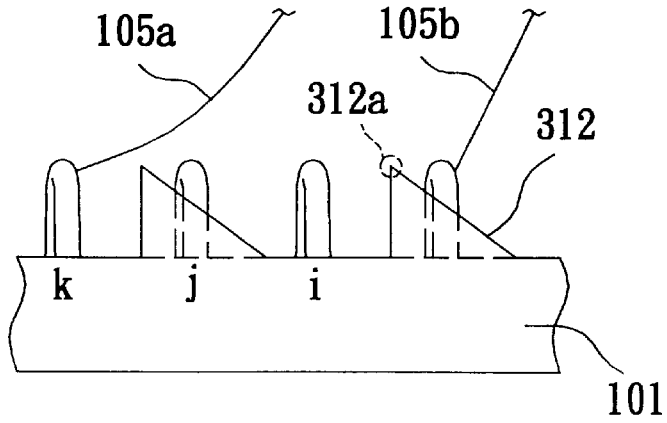

The process of separating the sheets by using the sheet feeding apparatus of the present invention is further explained as follows. In FIG. 4A, to illustrate the example below, a portion of the sheet separation pad 300 is magnified. A number of protrusions 312 and the spiral spring 311 are positioned on the base 101 of the sheet-separation pad 300. The spiral spring 311 includes a number of spring rings 317. Three adjacent spring rings 317 are labeled as spring ring i, spring ring j, and spring ring k, respectively. Two sheets, sheet 105*a* and sheet 105*b*, are placed on the sheet-separation pad 300. The sheet 105*a* is placed between the spring ring i and the spring ring j. As shown in FIG. 4B, the original distance between the spring ring i and spring ring j is approximately equal to the distance between spring ring j and spring ring k. As shown in FIG. 4C, when the sheet 105*a* is driven by the roller (not shown) and contacts the spring ring j, the spring ring j is indirectly driven forward. The roller has no direct contact with other sheets, so the other sheets below sheet 105*a* will not advance forward. Therefore, the sheet 105*a* is separated from the other sheets. In FIG. 4C, the sheet 105*a* is elevated to the highest point 312*a* of the inclined protrusion 312. As the roller (not shown) continues to drive the sheet 105*a* forward, the sheet 105*a* will move over the top of the spring ring j and fall into the gap between the spring ring j and the spring ring k, and then the spring ring j will return to its original position.

Through the aforementioned sheet separation process, even if there are two or more sheets fall into the same gap between two spring rings, these sheets will be separated gradually. Moreover, the spiral spring 317 can be replaced by other elastic devices such as spring leaves.

Figure 5:
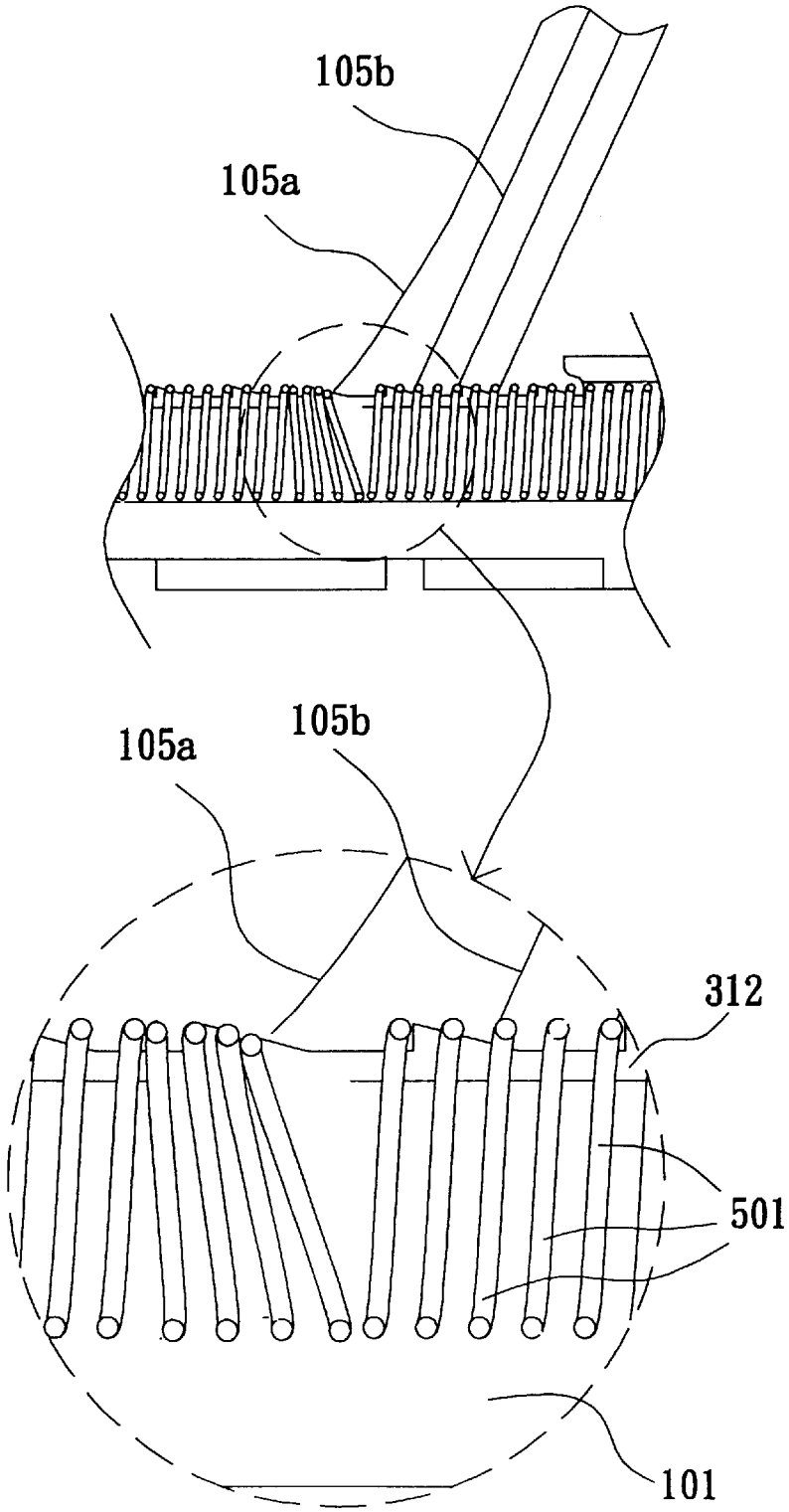
FIG. 5 shows another sheet feeding apparatus of the invention, using a series of connected spring leaves to facilitate sheet separation.

Referring to FIG. 5, it shows a sheet feeding apparatus according to another embodiment of the present invention, wherein a series of connected spring leaves facilitates the sheet-separation process. Similarly to the sheet-separating pad 300 and the base 101 shown in FIG. 3A, the inclined protrusions 312 are formed along both sides of the groove 310. In FIG. 5, the bottoms of the leaf springs 501 are fixed at the bottom of groove 310. The top of the leaf springs 501 is approximately as high as the highest point 312*a* of the protrusions 312.

Figure 1A:
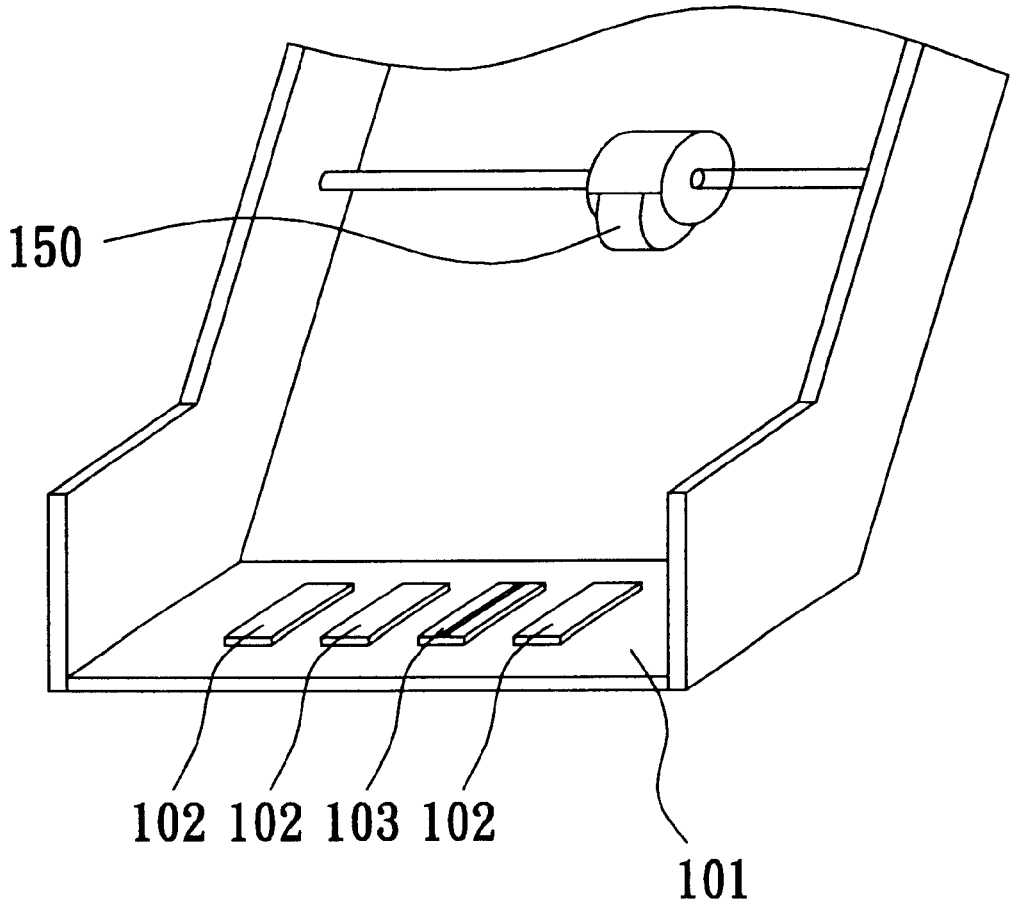
FIG. 1A (PRIOR ART)
FIG. 1A shows a conventional automatic sheet feeding apparatus.
Figure 1B:
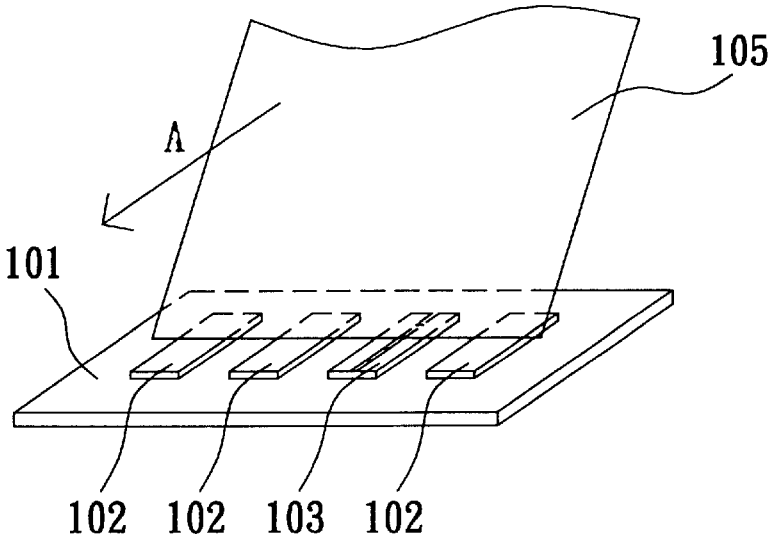
FIG. 1B (PRIOR ART)
FIG. 1B shows the front view of the movement of the sheets, according to conventional sheet feeding apparatus of FIG. 1A.
Figure 1C:
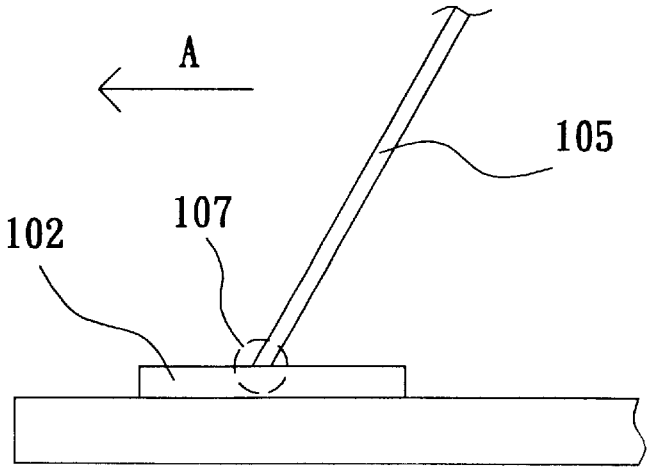
FIG. 1C (PRIOR ART)
FIG. 1C shows the side view of the movement of the sheets, according to conventional sheet feeding apparatus of FIG. 1A.
Figure 1D:
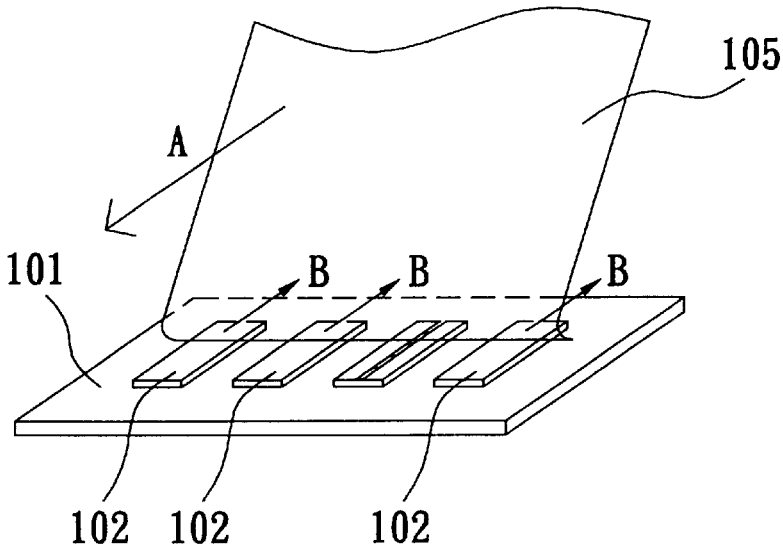
FIG. 1D (PRIOR ART)
FIG. 1D illustrates the friction to the sheet.
Figure 1E:
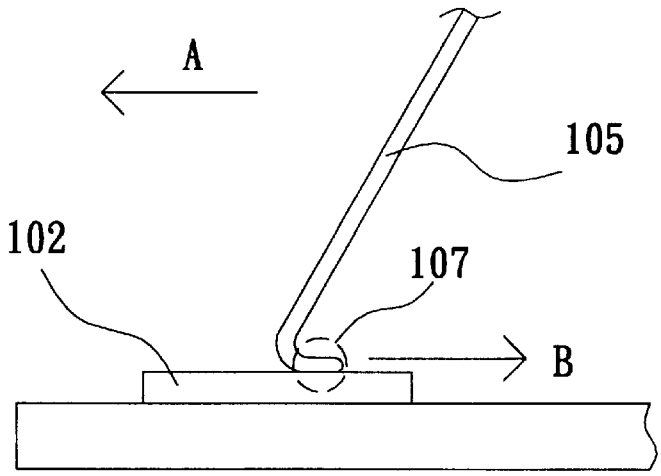
FIG. 1E (PRIOR ART)
FIG. 1E shows the sheet bending at the lower edge.
Figure 2:
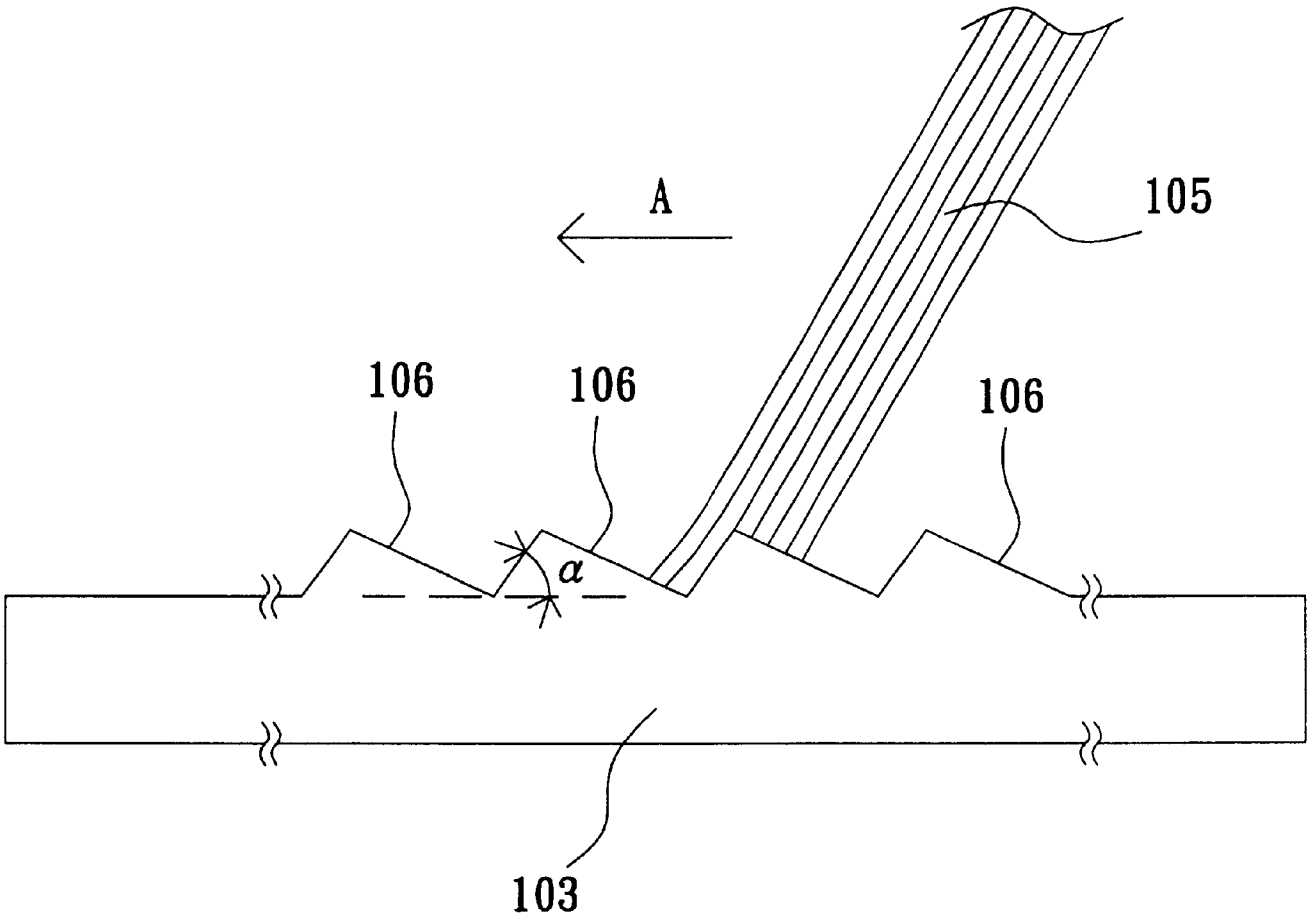
FIG. 2 (PRIOR ART)
FIG. 2 shows the side view of the sheet-separating pad and the sheets, according to conventional sheet feeding apparatus of FIG. 1A.

The sheet-separating pad of the present invention can separate sheets of various materials and thickness by the forward and backward motion of an elastic device, such as the spring leaves. In comparison, the conventional sheet-separating pad of FIGS. 1A and 2 can separate a less variety of sheets because the protrusions on the pad have a fixed incline angle $\alpha$. Furthermore, the sheet feeding apparatus with the sheet-separating pads of the invention is simple in structure and thus simple to manufacture. Because the precision requirement in manufacturing is not as strict as that of the conventional one. Hence, the sheet feeding apparatus of the present invention is a cost-effective solution.

Figure 6:
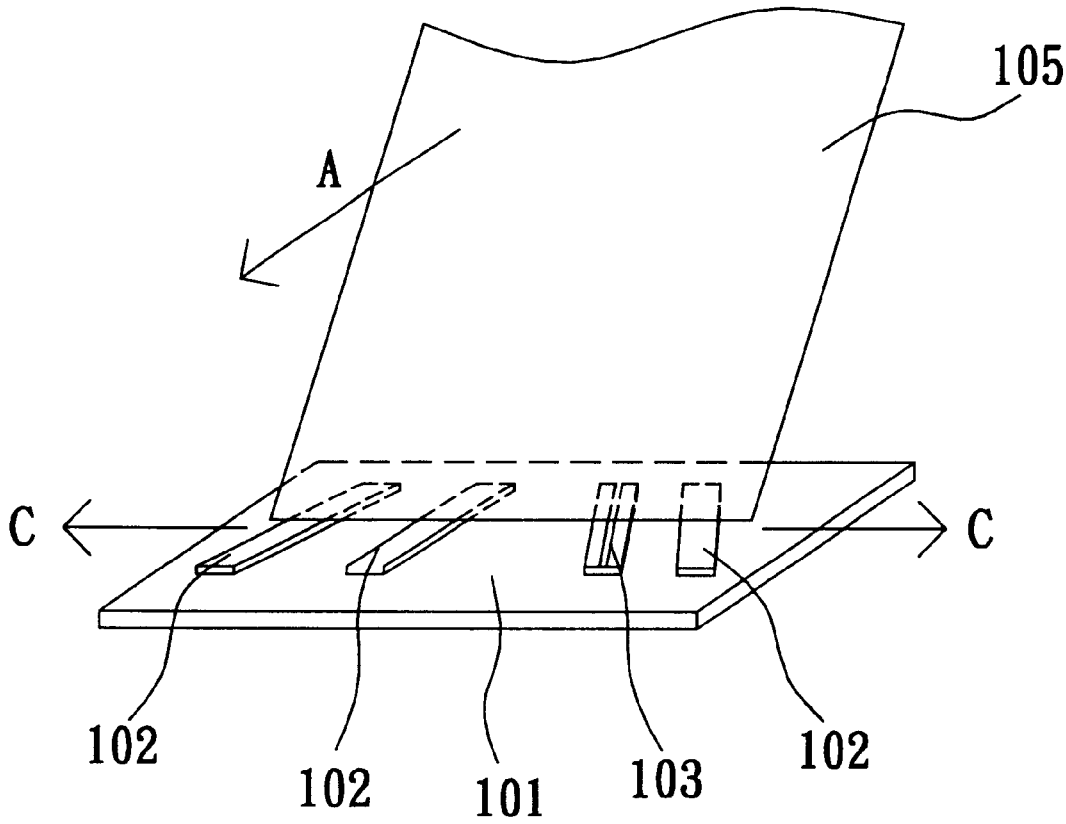
FIG. 6 shows the radial arrangement of the ribs and the sheet-separating pad of the pad base.

A further improvement of the sheet feeding apparatus, which prevents sheets from rolling up and the consequential paper jam, is disclosed. It is achieved by the radial arrangement of the ribs 102 and the sheet-separating pad 103 shown in FIG. 6. The surfaces of the ribs 102 are smooth. While the sheet 105 moves, friction force C pushes the sheet 105 toward two sides of the sheet separating apparatus but does not hinder the movement of the sheet 105 toward the direction A. The sheet 105 moves forward smoothly and is prevented from rolling up, therefore eliminating a potential paper jam.

Figure 7A:
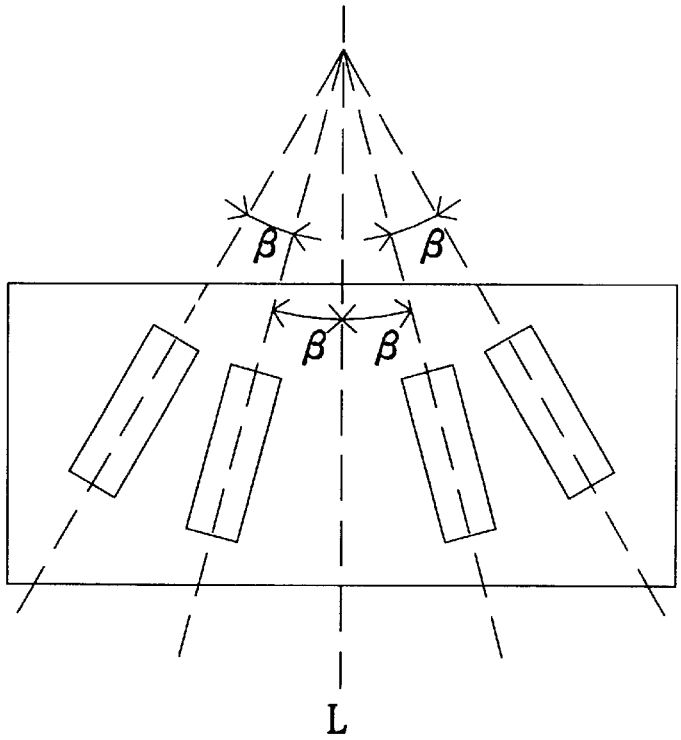
FIG. 7A shows the top view of the ribs and the sheet-separating pad according to a preferred embodiment of the invention.

FIG. 7A shows the top view of the ribs and the sheet-separating pad according to another embodiment of the invention. The longitudinal axis of the inner rib and the sheet-separating pad are relative to the paper sheet movement direction A with an angle â. The outer ribs are positioned at the same angle â to the inner rib and sheet-separating pad ■ so the longitudinal axis of the ribs and the sheet-separating pad are relative to each other with an angle â. The angle â is not limited as long as the radial arrangement generates a friction force in a direction perpendicular to the direction of sheet movement, which pushes the sheet 105 smoothly and thus prevents the sheet from bending but allows the sheet 105 to move smoothly.

Figure 7B:
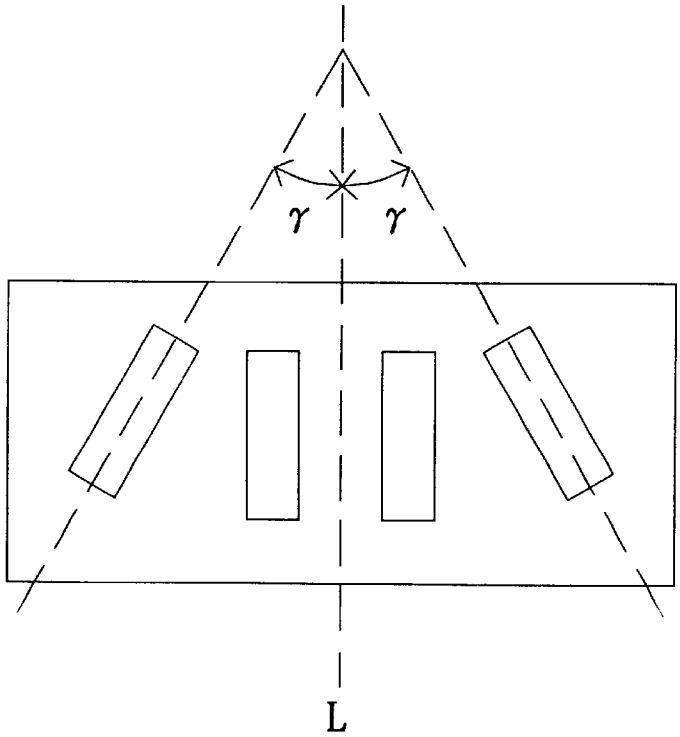
FIG. 7B shows another top view of the ribs and the sheet-separating pad according to a preferred embodiment of the invention.

FIG. 7B shows another top view of the ribs and the sheet-separating pad according to further embodiment of the invention. The longitudinal axis of the inner rib and the sheet-separating pad are both parallel to the paper sheet movement direction A, while the longitudinal axis of the two outer ribs are relative to the direction A with an angle γ so that the friction force in a direction perpendicular to the direction of sheet movement generated pushes the sheet 105 smoothly and thus prevents the sheet from bending but allows the sheet 105 to move smoothly.

The sheet feeding apparatus of the invention disclosed herein offers the following advantages:

1. wider range of suitable printing materials;
2. high accuracy in sheet separation;
3. prevention of paper jams; and
4. reduction in cost.

While the invention has been described by way of examples and in terms of the preferred embodiments, it is to be understood that the invention is not limited hereto. On the contrary, it is intended to cover various modifications and similar arrangements and procedures, and therefore the scope of the appended claims should be accorded the broadest interpretation so as to encompass all such modifications and similar arrangements and procedures.

What is claimed is:

1. A sheet-separating pad for a sheet feeding apparatus for use in an image forming apparatus, the sheet-separating pad comprising:

a pad base having a top surface and a groove, the groove being formed in the top surface;

a plurality of inclined protrusions formed at one side of the groove; and a spiral spring within the groove, a top of the spiral spring protruding above the top surface of the pad base for separating sheets.

2. A sheet-separating pad for a sheet feeding apparatus of an image forming apparatus, the sheet-separating pad comprising:

a pad base having a top surface and a groove, the groove being formed in the top surface;

a plurality of inclined protrusions formed at one side of the groove; and an elastic device within the groove, a top of the elastic device protruding above the top surface of the pad base for separating sheets, wherein the elastic device includes a series of connected spring leaves.

3. A sheet feeding apparatus for use in an image forming apparatus, the sheet feeding apparatus comprising:

a base; and a sheet-separating pad formed on the base, the sheet-separating pad including a pad base having a groove formed on a top surface of the pad base, a longitudinal axis of the groove being parallel to a sheet movement direction A, a plurality of inclined protrusions formed at one side of the groove, and an elastic device placed within the groove, the elastic device protruding above the top surface of the pad base for separating the sheets and including a first spring ring and a second spring ring, the first and the second spring ring being higher than the pad base and approximately as high as a highest point of the inclined protrusions, wherein when a sheet is moved onto the highest point of the inclined protrusions, the sheet is movable over the first spring ring and to the second spring ring.

4. The sheet feeding apparatus of claim 3, wherein the elastic device is a spiral spring.

5. The sheet feeding apparatus of claim 3, wherein the elastic device comprises a plurality of connected spring leaves.

6. The sheet feeding apparatus of claim 3, wherein the sheet feeding apparatus further comprises a plurality of ribs formed on the base, and the ribs are arranged radially.

7. The sheet feeding apparatus of claim 6, wherein the ribs comprise an inner rib and an outer rib, a first longitudinal axis of the inner rib is parallel to the sheet movement direction A, and a second longitudinal axis of the outer rib is relative to the sheet movement direction A with an angle.

* * * * *